US007043188B2

(12) United States Patent
Curynski et al.

(10) Patent No.: US 7,043,188 B2
(45) Date of Patent: May 9, 2006

(54) CLEANING DEVICE FOR CLEANING A MOVING SURFACE

(75) Inventors: Martin J. Curynski, Webster, NY (US); Dhirendra C. Damji, Webster, NY (US); Bruce A. Dangelmaier, W. Henrietta, NY (US); Karl E. Kurz, Rochester, NY (US); Arthur F. McLean, Webster, NY (US)

(73) Assignee: Xerox Corporation, Stamford, CT (US)

( * ) Notice: Subject to any disclaimer, the term of this patent is extended or adjusted under 35 U.S.C. 154(b) by 123 days.

(21) Appl. No.: 10/812,518

(22) Filed: Mar. 30, 2004

(65) Prior Publication Data

US 2005/0220513 A1 Oct. 6, 2005

(51) Int. Cl.
*G03G 21/10* (2006.01)

(52) U.S. Cl. ..... 399/346

(58) Field of Classification Search ..... 399/346
See application file for complete search history.

(56) References Cited

U.S. PATENT DOCUMENTS

| | | | | | |
|---|---|---|---|---|---|
| 3,895,135 | A | | 7/1975 | Fleisig et al. | 427/248 |
| 3,957,509 | A | * | 5/1976 | McMullen et al. | 399/347 |
| 4,007,982 | A | * | 2/1977 | Stange | 399/351 |
| 4,172,303 | A | * | 10/1979 | Wooding et al. | 15/256.52 |
| 4,267,616 | A | * | 5/1981 | Hunt | 15/182 |
| 4,323,306 | A | * | 4/1982 | Ito et al. | 399/358 |
| 4,395,113 | A | | 7/1983 | Buchan et al. | 355/15 |
| 4,870,465 | A | * | 9/1989 | Lindblad et al. | 399/347 |
| 5,322,015 | A | * | 6/1994 | Gasparrini | 101/425 |
| 5,349,429 | A | * | 9/1994 | Jugle et al. | 399/346 |
| 5,761,598 | A | * | 6/1998 | Kazakos et al. | 399/349 |
| 5,802,667 | A | * | 9/1998 | Williams | 15/395 |
| 5,991,568 | A | * | 11/1999 | Ziegelmuller et al. | 399/102 |
| 6,453,134 | B1 | * | 9/2002 | Ziegelmuller et al. | 399/101 |
| 2004/0109711 | A1 | * | 6/2004 | Kanagawa | 399/350 |
| 2005/0002705 | A1 | * | 1/2005 | Shintani et al. | 399/346 |
| 2005/0047804 | A1 | * | 3/2005 | Kosuge | 399/27 |
| 2005/0074264 | A1 | * | 4/2005 | Amemiya et al. | 399/346 |
| 2005/0152722 | A1 | * | 7/2005 | Tawada et al. | 399/346 |
| 2006/0024100 | A1 | * | 2/2006 | Ohta et al. | 399/350 |

* cited by examiner

*Primary Examiner*—Gail Verbitsky
(74) *Attorney, Agent, or Firm*—Lloyd Bean, II

(57) ABSTRACT

An apparatus for cleaning a moving surface having toner particles thereon, including: a housing defining an open ended chamber; means, disposed in the chamber of the housing with a portion thereof extending outwardly from the open end of the chamber of the housing into contact with the surface, for cleaning toner particles therefrom, the removed particles moving away from the cleaning means; means for lubricating the cleaning means, the lubricating means located downstream from the cleaning means, in a direction of motion of the surface, the lubricating means collecting and transporting toner particles from a center portion of the moving surface to both end portion of the moving surface; and an auger, located downstream from the cleaning means and the lubricating means, in the direction of motion of the surface, collecting the toner particles that escape from the lubricating means.

7 Claims, 3 Drawing Sheets

CLEANING DEVICE FOR CLEANING A MOVING SURFACE

BACKGROUND

This invention relates generally to an electrophotographic printing device, and more particularly, a lubricating system in the cleaner apparatus that removes particles adhering to an imaging surface (i.e. photoreceptor or photoconductor).

In an electrophotographic application such as xerography, a charge retentive surface is electrostatically charged, and exposed to a light pattern of an original image to be reproduced to selectively discharge the surface in accordance therewith. The resulting pattern of charged and discharged areas on that surface form an electrostatic charge pattern (an electrostatic latent image) conforming to the original image.

The latent image is developed by contacting it with a finely divided electrostatically attractable powder referred to as "toner". Toner is held on the image areas by the electrostatic charge on the surface. Thus, a toner image is produced in conformity with a light image of the original being reproduced. The toner image may then be transferred to a substrate (e.g. paper), and the image affixed to form a permanent record of the image to be reproduced.

Subsequent to development, excess toner left on the charge retentive surface is cleaned from the surface. The process is well known, and useful, for light lens copying from an original and printing applications from electronically generated or stored originals, where a charge surface may be imagewise discharged in a variety of ways. Ion projection devices, where a charge is imagewise deposited on a charge retentive substrate, operates similarly. In a reproduction process of the type as described above, it is inevitable that some residual toner will remain on the photoconductor surface after the toner image has been transferred to the sheet of support material (e.g. paper).

It has been found that with such a process the forces holding some of the toner particles to the imaging surface are stronger than the transfer force and, therefore, some of the particles remain on the surface after transfer of the toner image. In addition to the residual toner, other particles, such as paper debris (i.e. Kaolin, fibers, clay), additives and plastic, are left behind on the surface after image transfer. (Hereinafter, the term "residual particles" encompasses residual toner and other residual debris remaining after image transfer.) The residual particles adhere firmly to the surface and must be removed prior to the next printing cycle to avoid it's interfering with recording a new latent image thereon.

Various methods and apparatus may be used for removing residual particles from the imaging surface. One such method and/or apparatus is the use of a cleaning blade. Blade cleaning involves the blade, normally made of a rubber-like material (e.g. polyurethane) which is dragged or wiped across the surface to remove the residual particles from the surface. Blade cleaning is a highly desirable method, compared to other methods (e.g. brushes and webs), for removing residual particles due to it's simple, inexpensive structure. To assure reliable and effective cleaning of the image surface, a certain amount of force, of necessity, must be applied to the blade to maintain the cleaning edge against the imaging surface with sufficient pressure to avoid allowing any particulate material on the imaging surface to slip pass.

On many printers and copiers the cleaning blade experiences blade failures associated with a lack of lubrication.

The premature failures increase the unscheduled maintenance rates and the cost associated with a high unscheduled maintenance rate. The failures, which are hard failures (i.e. the customer can no longer use the machine), adversely affect customer satisfaction.

The following disclosures may be relevant to various aspects of the present invention and may be briefly summarized as follows:

U.S. Pat. No. 4,395,113 to Buchan et al. discloses a method and apparatus for cleaning a photoconductive surface in order to remove toner particles dispersed in a liquid developer wherein a smoother-surface, resiliently deformable, yieldable roller means is compliantly engaged with the surface to be cleaned so as to form a generally concave, smooth-surfaced cleaning pad space from the photoconductive surface by a gap not exceeding the diameter of minimum sized toner particles. The yieldable roller means is rotated such that the surface of the concave, smooth-faced portion thereof moves in an opposite direction relative to the direction of movement of the photoconductive surface and at a velocity at least equal to that of the photoconductive surface.

U.S. Pat. No. 3,895,135 to Fleisig et al. discloses a precisely dimensioned liquid reservoir which is formed by selecting an open-celled, porous form material, saturating the foam with a suitable liquid and thereafter cutting or shaping the foam into the particular form required.

SUMMARY

Briefly stated, and in accordance with the present invention, there is provided an apparatus for cleaning a moving surface having toner particles thereon, comprising: a housing defining an open ended chamber; means, disposed in the chamber of said housing with a portion thereof extending outwardly from the open end of the chamber of said housing into contact with the surface, for cleaning toner particles therefrom, said removed particles moving away from said cleaning means; means for lubricating said cleaning means, said lubricating means located downstream from said cleaning means, in a direction of motion of the surface, said lubricating means collecting and transporting toner particles from a center portion of said moving surface to both end portions of said moving surface; and an auger, located downstream from said cleaning means and said lubricating means, in the direction of motion of the surface, collecting the toner particles that escape from said lubricating means.

BRIEF DESCRIPTION OF THE DRAWINGS

Other features of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Due to the nature of printers, for example, there is a large amount of dead cycling in which no toner or lubrication is added to the system. These situations are very stressful for a blade system that requires a constant level of lubrication. This is even more critical in toner systems that rely on materials such as Kynar for lubrication. (Kynar acts as a ball-bearing and does not coat the photoreceptor surface like, for instance, zinc stearate.) The present invention provides a method of supplying a continuous amount of toner and/or Kynar (i.e. lubrication) to a blade even though no new lubrication is entering the system. The present invention uses waste toner as the source of lubrication. Although the cleaning apparatus, utilizing a foam lubricating roll, of the present invention is particularly well adapted for use in an electrophotographic printing machine, it should become evident from the following discussion, that it is equally well suited for use in other applications and is not necessarily limited to the particular embodiments shown herein.

Figure 1:
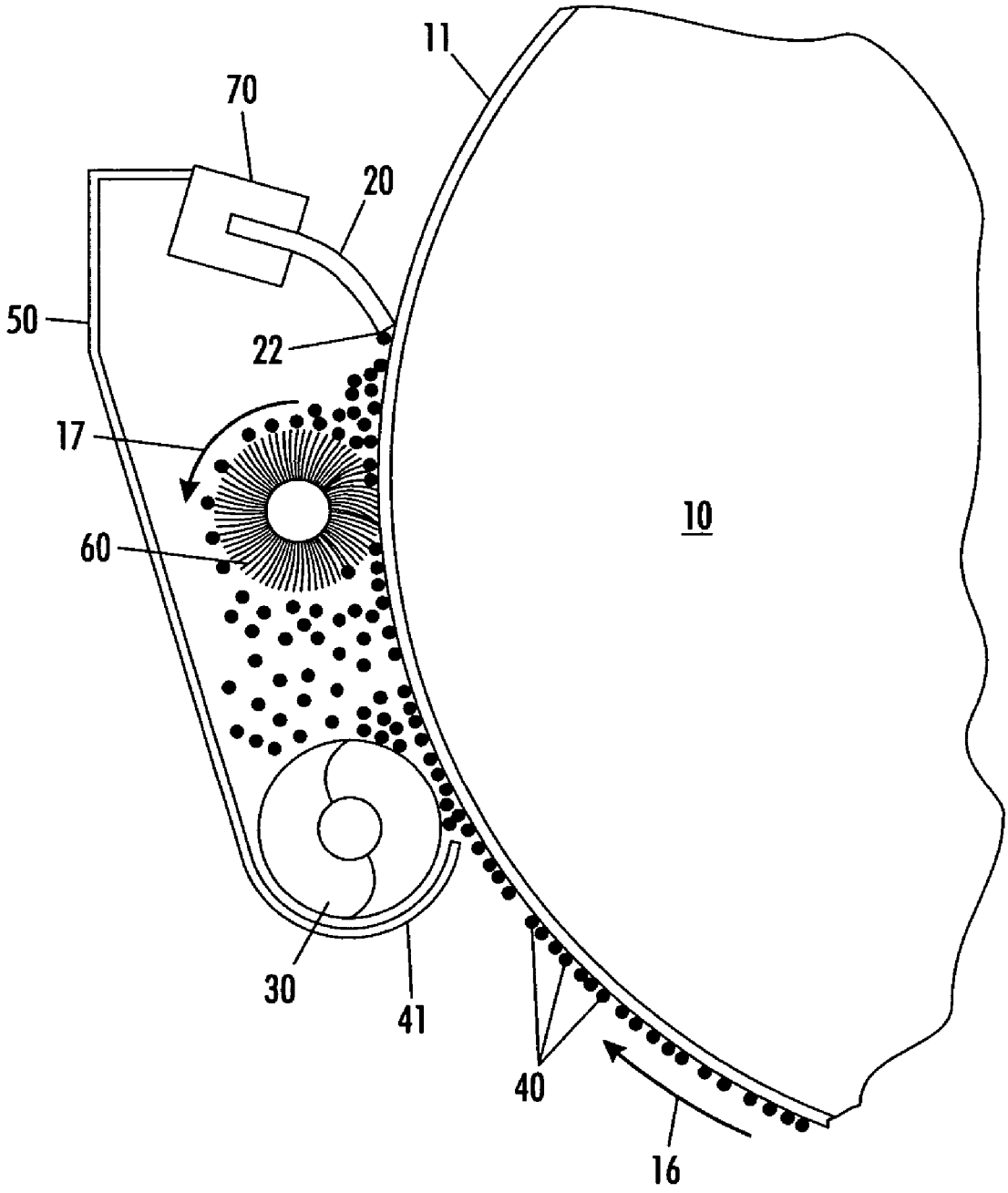
FIG. 1 is an elevational view of the present invention.
Figure 2:
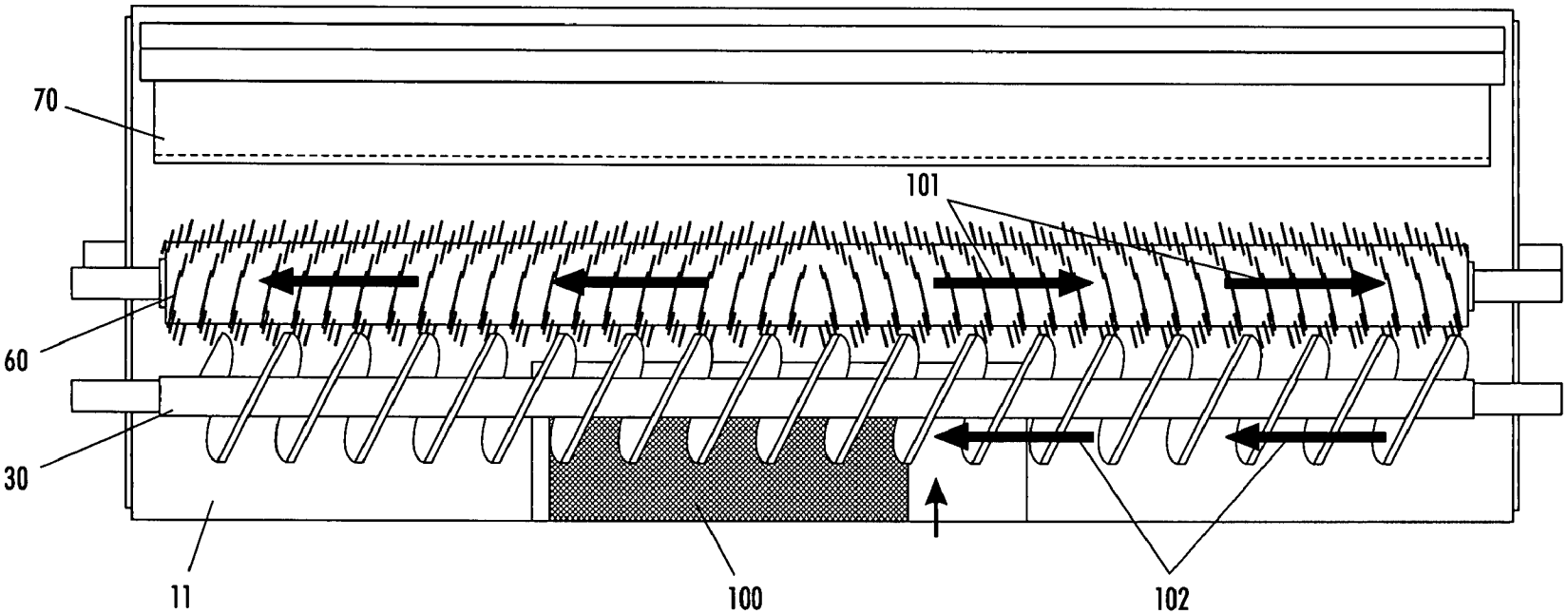
FIGS. 2 and 3 an elevational top view of the present invention.
Figure 3:
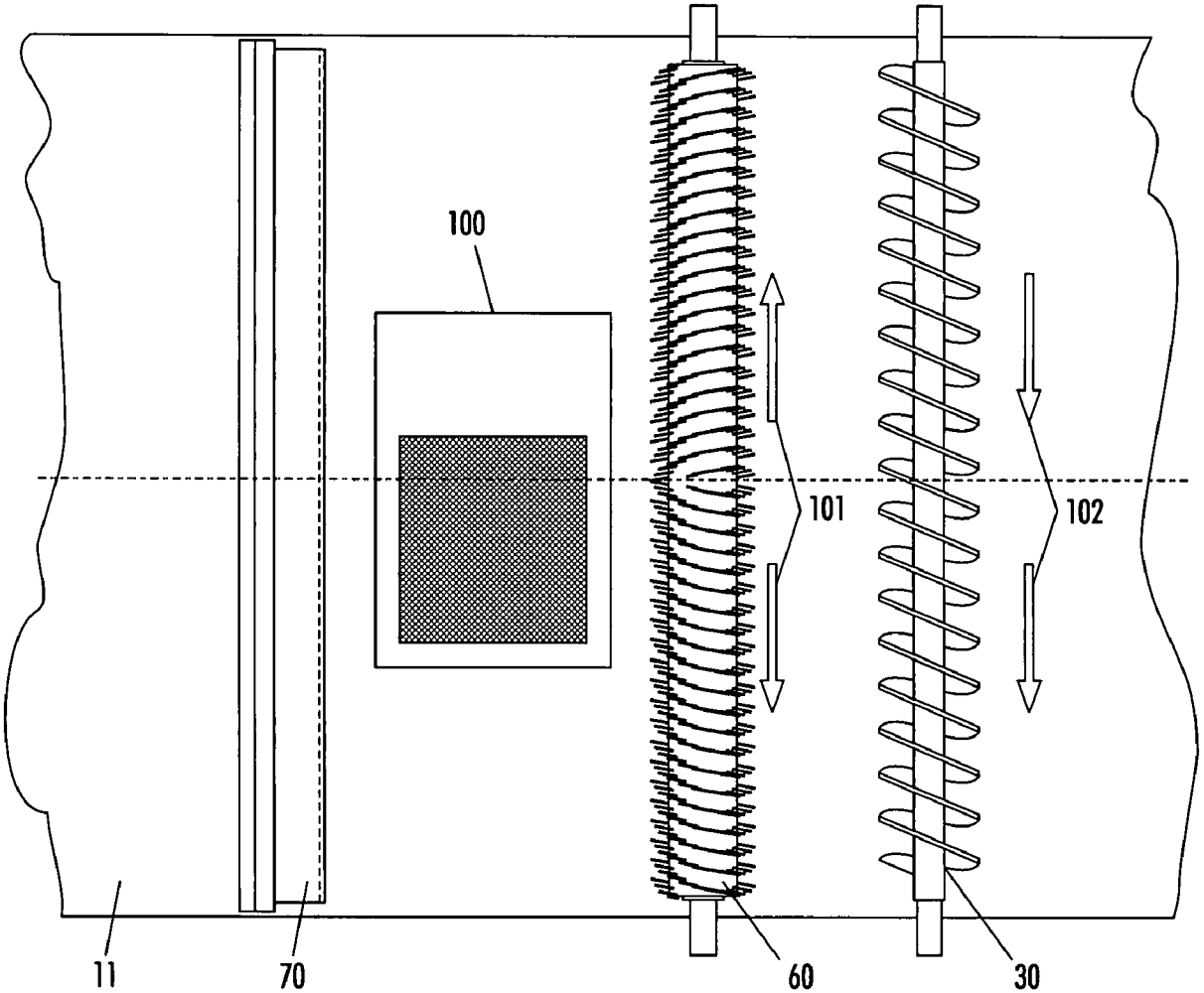

Referring to FIGS. 1–3, the configuration consists of a blade 20 in a blade holder 70 that scrapes the waste toner 40 from the photoreceptor 10 allowing this toner 40 to cascade or be transported into the transport auger 30. As the photoreceptor surface 11 rotates, in the direction indicated by arrow 16, the toner 40 is brought into contact with the cleaning blade 20 and the toner 40 is removed. The toner 40 falls away from the blade tip 22 and is augered to a waste bottle (not shown) by the transport auger 30. A film seal 41 prevents waste particles, removed from the photoreceptor, from escaping the cleaner housing 50.

During long dead cycles the blade 20 loses all lubrication because gravity removes any remaining toner dam (i.e. stored toner that can occur at the blade and photoreceptor intersection). This loss of lubrication can happen rapidly where gravity is employed to remove toner from the cleaning edge, for example, in a vertical cleaner system where toner falls away from the cleaning edge. It can also occur in a cleaner system where gravity is not employed. In this instance some toner is "stored" on the face of the blade and this toner lubricates the blade for some period of time. But, in both of the above examples, the blade configurations will fail if toner is not supplied to the blade because the blade 20 sticks to the photoreceptor surface 11 and "tucks" (i.e. the cleaning blade edge folds under) typically causing a catastrophic failure.

Reference is now made to FIG. 2, which shows the present invention. The present invention adds a bi-directional brush which is placed in front of the blade tip 22, in the direction of motion of the photoreceptor, and in full contact with the photoreceptor surface (e.g. imaging surface) 11. The brush 60 is supported by a set of bearings on either end that allow the brush 60 to freewheel and turn, in a direction indicated by the arrow 17, in the direction of motion of the photoreceptor drum 10. (Note: The brush 60 can also be driven rather than allowed freewheel motion.)

Applicants have found that blades fail due to flipping or tucks when they experience extended running with little toner input for lubrication between the blade edge and the photoreceptor surface. To avoid this condition, the typical disturber brush, located upstream of the cleaning blade, is modified to also act as a bi-directional toner auger. The brush pile fabric tapes are wound onto the brush core to form auger flutes that transport toner to both edges of the photoreceptor from the statistical center 90 of the developed toner mass 100. This enables transportation of toner in direction shown by arrow 101 from high lubrication areas to low lubrication areas and prevents blade failures at low cost.

Principles of the present invention was tested with test fixture similar to FIGS. 1–33. A Taguchi test was run with very low toner input to the inboard and outboard ends of the blade. Blade flips and tucks were experienced at about 2 kp with a standard disturber brush. When using the bi-directional disturber brush, no failures were observed after 90 kp.

The excess that is not held in the brush 60 will then escape from the foam roll into the transport auger 30 and is then moved to the waste toner 40 by the auger 30. The brush 60 then acts as a donor roll by supplying the photoreceptor surface 11 with toner 40 during periods of dead cycling. The brush continuously supplies toner to the photoreceptor, especially in areas where there is no imaging, i.e. background areas. The brush 60 rotatingly and compliantly makes contact with the imaging surface 11. The level of toner 40 that will be supplied to the photoreceptor surface 11 will be adequate to lubricate the blade 20 and prevent the blade failures previously described.

The present invention will significantly improve the current blade life for the engineering copiers that rely on the toners to lubricate the blade. The extended life and reduction in the unscheduled maintenance rates will decrease the cost of service and increase the customer satisfaction ratings.

In recapitulation, the present invention utilizes a brush to collect toner particles cleaned from the imaging surface. The brush is located downstream from the cleaning blade, in the direction of motion of the imaging surface. The brush lubricates the imaging surface by rotatingly contacting the imaging surface and thus, reapplying toner to the imaging surface. This lubrication of the surface, in turn, lubricates the cleaning blade during periods of dead cycling.

It is, therefore, apparent that there has been provided in accordance with the present invention, a cleaning apparatus that lubricates the cleaning blade that fully satisfies the aims and advantages hereinbefore set forth.

While this invention has been described in conjunction with the specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for cleaning a moving surface having toner particles thereon, comprising:

a housing defining an open ended chamber;

cleaning means, disposed in the chamber of said housing with a portion thereof extending outwardly from the open end of the chamber of said housing into contact with the surface, for cleaning toner particles therefrom, said removed particles moving away from said cleaning means;

means for lubricating said cleaning means, said lubricating means located downstream from said cleaning means, in a direction of motion of the surface, said lubricating means collecting and transporting toner particles from a center portion of said moving surface to both end portions of said moving surface; and an auger, located downstream from said cleaning means and said lubricating means, in the direction of motion of the surface, collecting the toner particles that escape from said lubricating means.

2. An apparatus as recited in claim 1, wherein said cleaning means comprises a blade.

3. An apparatus as recited in claim 2, wherein said lubricating means comprises a brush.

4. An apparatus as recited in claim 3, wherein said brush comprises brush pile located on a brush core forms auger flutes that collects and transports toner.

5. An apparatus as recited in claim 3, wherein said brush is rotatably mounted.

6. An apparatus as recited in claim 5, wherein said brush rotates in a same direction as the direction of motion of the surface.

7. An apparatus as recited in claim 3, wherein said brush contacts the surface to continuously supply and transport the collected toner particles to the surface to lubricate said blade.

* * * * *